US005259552A

United States Patent [19]

Kuchenbecker

[11] Patent Number: 5,259,552

[45] Date of Patent: Nov. 9, 1993

[54] TOP PANEL SPOUT CARTON

[75] Inventor: Morris W. Kuchenbecker, Neenah, Wis.

[73] Assignee: James River Corporation of Virginia, Richmond, Va.

[21] Appl. No.: 887,043

[22] Filed: May 22, 1992

Related U.S. Application Data

[63] Continuation-in-part of Ser. No. 635,367, Dec. 28, 1990, abandoned.

[51] Int. Cl.[5] ..... B65D 5/74

[52] U.S. Cl. ..... 229/207; 229/208; 229/219; 229/234

[58] Field of Search ..... 229/207, 208, 217, 218, 229/219, 229, 234

[56] References Cited

U.S. PATENT DOCUMENTS

| | | | |
|---|---|---|---|
| 3,563,447 | 2/1971 | Katzenmeyer | 229/208 |
| 4,613,046 | 9/1986 | Kuchenbecker | 229/208 |
| 4,718,557 | 1/1988 | Friedman | 229/229 X |
| 4,746,019 | 5/1988 | Prater | 229/207 |
| 4,909,395 | 3/1990 | Weissman | 229/208 |
| 4,941,575 | 7/1990 | Friedman | 229/229 X |
| 4,944,406 | 7/1990 | Zehnal | 229/208 X |
| 4,989,735 | 2/1991 | O'Brien | 229/234 |
| 5,000,320 | 3/1991 | Kuchenbecker | 229/208 X |
| 5,007,542 | 4/1991 | Roccaforte | 229/208 X |
| 5,035,330 | 7/1991 | Kuchenbecker | 229/207 X |

FOREIGN PATENT DOCUMENTS 635001 1/1962 Canada .

*Primary Examiner*—Allan N. Shoap
*Assistant Examiner*—Christopher McDonald
*Attorney, Agent, or Firm*—Sixbey, Friedman, Leedom & Ferguson

[57] ABSTRACT

A carton is disclosed having a reclosable pour spout formed in a top panel thereof. The pour spout being formed by cooperating portions of an upper minor flap, an exterior top panel and an interior top panel which cooperate to form the top panel of the carton. A portion of the interior top panel forming a central closure pane is formed by inside and outside cut scores formed in the interior top panel defining a ply separation region therebetween which extends from a lift tab to a hinge line formed in the interior top panel. The exterior top panel includes a central closure pane defined by lines of perforation which extend from the lift tab to a hinge line formed in the exterior top panel which overlies the hinge line formed in the interior top panel, such that upon the application of an opening force to the lift tab, ply separation occurs in the ply separation region of the interior top panel which consequently forms a stop lip in the interior top panel and a stop tab on the central closure pane which when reclosed contacts the stop lip and prevents the central closure pane from being inserted into an interior of the carton.

42 Claims, 12 Drawing Sheets

TOP PANEL SPOUT CARTON

This is a continuation-in-part application of U.S. application Ser. No. 635,367 filed Dec. 28, 1990.

BACKGROUND OF THE INVENTION

Paperboard cartons convey products from manufacturer to consumer admirably. Even though inexpensive, they are durable, protective and easily imprinted with instructions, information and attractive graphics. They are even better at storing the product on the shelf prior to initial use but a fair degree of self-control can be required to avoid becoming at least mildly aggravated when trying to open "easy-open" spouts or to reclose reclosable flaps such as are found on many prior art cartons. At one time, metal pour spouts found widespread use on many cartons for granular products but, with ever increasing competitive and ecological pressure, the relatively expensive metal pour spout has become, if not an exorbitant luxury, then at least an expensive frill, better eliminated if at all possible.

Pour spouts formed entirely of paperboard can be less expensive than metal spouts but so far it has proved exceedingly difficult to combine a reliable, reclosable, easily opened pour spout with a simple design which is both frugal with board and suitable for existing high speed packaging machinery. Pending U.S. Pat. application No. 07/563,361 discloses side panel pour spout cartons largely overcoming these problems while requiring only a moderate additional board area over that required for the basic carton. However, as with all side panel pour spout cartons, if filled to the top, care may be required to prevent product from spilling upon initial opening.

SUMMARY OF THE INVENTION

The carton of the present invention may easily be manufactured on existing machinery without requiring patterned application of adhesive and uses only the amount of board required for the basic carton while obviating possible spillage problems attendant upon opening. The sealed carton strongly resists infestation strongly and reseals firmly making it highly resistant to spills even after initial opening. Cooperating incisions formed in one of the minor flaps and both top panels constitute a multi-layer top panel pour spout feature having a central closure pane incorporating portions of both the exterior and interior top panels of the carton. Upon resealing, strong frictional forces firmly retain the central closure pane over the opening so that minor bumps and jostles can be tolerated without accidentally reopening the carton and undesirably spilling product.

Beginning at one edge of the exterior top panel, a first through cut substantially normal thereto is formed leading rearwardly to a first line of perforation intersecting therewith and extending rearwardly to a first hinge line such as a crease score substantially normal to the line of perforation extending transversely across the top panel of the carton to a second line of perforations leading forwardly to a second through cut extending forwardly to the edge of the carton. A slight protrusion of the exterior top panel between the first and second through cuts extends over the edge of the carton to facilitate opening of the top panel pour spout feature.

Formed in the interior top panel immediately underlying the first through cut is a third through cut extending rearwardly therebeneath. At a point underlying the intersection of the first through cut and the first line of perforations, the third through cut intersects with a first upper cut score formed in the interior top panel underlying the first line of perforations and extending rearwardly to a second hinge line underlying said first hinge line. A first interior cut score begins at the intersection of the third through cut with the first upper cut score and extends rearwardly to the second hinge line along a line displaced inwardly from the first upper cut score between the first and second lines of perforations. A second upper cut score underlies the second line of perforations and extends forwardly to a point underlying the intersection of the second through cut with the second line of perforations where the second upper cut score intersects with a fourth through cut underlying the second through cut and extending forwardly to the edge of the carton. Beginning at a point intersecting the second hinge line between the first interior cut score and the second line of perforations, a second interior cut score extends forwardly to a point underlying the intersection of the second upper cut score and the fourth through cut. A portion of the interior top panel protrudes beyond the edge of the carton between the third and fourth through cuts.

Third and fourth upper cut scores are formed in the minor flap underlying the third and fourth through cuts and each extends rearwardly beneath one of those through cuts to a point lying beneath the intersection of its respective through cut with the adjoining upper cut score formed in the interior top panel. An aperture is formed in the minor flap underlying the region defined by the first and second interior cut scores, the hinge lines and an imaginary line extending between the intersections of each of the first and second through cuts with its adjoining line of perforations.

A fifth through cut may be formed in the interior top panel extending along the line between, but not bridging, the intersections of the first and second upper cut scores with the adjoining through cuts.

The carton is opened by lifting the protrusions upward, grasping the lift tab defined by the sections of the top panels lying between the first and second through cuts and pulling the lift tab upwardly and rearwardly thereby inducing ply separation in the region between the third and fourth upper cut scores formed in the minor flap, parting the exterior top panel along the lines of perforations while inducing ply separation in the two regions of the interior top panel adjacent to and located between the first and second upper cut scores and thereby forming an opening extending through both top panels and the minor flap into the interior of the carton while simultaneously forming a central pane which comprises portions of the top panels lying between the interior cut scores.

In the erect and opened carton, attached to the central closure pane are: the lift tab extending to and slightly past the edge of the carton, as well as two stop tabs adjoining the central closure panel which incorporate one complete thickness of board and a ply-separated region of about half that in thickness. Adjacent the opening formed by upward and rearward movement of the central closure pane are two stop lips formed by that ply separation in regions of the interior top panel adjacent the central closure pane. Thus, the stop lips underlie and are engageable against the stop tabs attached to the central closure providing a highly effective means of preventing the central closure pane from passing through the pour spout opening and becoming lodged inside the carton. A glue lip is formed in the minor end flap underlying the lift tab while an opening through the minor end flap underlies the opening formed in both top panels by lifting of the central closure pane.

Upon initial opening, the stop tabs are formed by the regions of the exterior top panel adjacent the central closure pane of the spout as well as by the portions of the upper plies of the interior top panel which ply-separate from those regions of the interior top panel forming the stop lips adjacent the pour spout. Similarly, a retention lip is formed by ply separation of the glue lip. Both formation of the accessory spout structure and initial opening of the pour spout itself are accomplished by lifting the protrusions away from the carton, then grasping the lift tab and pulling upwardly and rearwardly toward the center of the carton.

Reclosing is accomplished by inserting the lift tab into the pour spout opening then tucking it under the retention lip formed by ply-separation of the glue lip on the minor end flap underlying the two top panels. The central closure pane is retained outside of the carton by engagement of the two stop tabs against the two stop lips adjoining the pour spout opening formed through the top panels and minor end flap.

Reopening may be eased by providing a readily attachable edge along the junction of the lift tab with the central closure panel as, for example, by a short through cut between the lift tab and the central closure pane or by removing or entirely omitting the portion of the exterior top panel overlying that portion of the interior top panel constituting the lift tab.

In accordance with an alternative embodiment of the present invention, a cutout is formed adjacent an edge of the exterior top panel leading rearwardly to first and second lines of perforation which intersect therewith and extend rearwardly to a first hinge line in the form of a crease score substantially normal to the lines of perforation and extending transversely across the exterior top panel of the carton. Formed in the interior top panel substantially underlying a periphery of the cutout is a first through cut extending rearwardly therebeneath. At a point underlying the intersection of the cutout and the first line of perforations, the first through cut intersects with a first upper cut score formed in the interior top panel substantially underlying and spaced inwardly of the first line of perforations and extending rearwardly to a second hinge line underlying said first hinge line. A second through cut begins at a point adjacent and spaced from the intersection of the first through cut with the first upper cut score and extends rearwardly to the second hinge line along a line displaced inwardly from the first upper cut score between the first and second lines of perforations. A second upper cut score substantially underlies and is slightly spaced inwardly of the second line of perforations and extends forwardly to a point underlying the intersection of the cutout with the second line of perforations where the second upper cut score intersects with a third through cut substantially underlying the periphery of the cutout and extending forwardly to the edge of the carton. Beginning at a point intersecting the second hinge line between the first interior cut score and the second line of perforations, a fourth through cut extends forwardly to a point adjacent to and spaced from the intersection of the second upper cut score and the third through cut. A portion of the interior top panel protrudes beyond the edge of the carton between the first and third through cuts.

Third and fourth upper cut scores are formed in the minor flap underlying the first and third through cuts and each extends rearwardly beneath one of those through cuts to a point lying beneath the intersection of its respective through cut with the adjoining upper cut score formed in the interior top panel. An aperture is formed in the minor flap substantially underlying the region defined by the second and fourth through cuts, the hinge lines and an imaginary line extending between the intersections of each of the first and third through cuts with its adjoining upper cut score. A fifth through cut may be formed in the interior top panel extending along the line between, but not bridging, the intersections of the first and second upper cut scores with the adjoining through cuts.

The carton is opened by lifting the protrusion upward, grasping the lift tab defined by the section of the interior top panels lying between the first and third through cuts and pulling the lift tab upwardly and rearwardly thereby inducing ply separation in the region between the third and fourth upper cut scores formed in the minor flap, parting the exterior top panel along the lines of perforations while inducing ply separation in the two regions of the interior top panel adjacent to and located between the first and second upper cut scores and thereby forming an opening extending through both top panels and the minor flap into the interior of the carton while simultaneously forming a central pane which comprises portions of the top panels lying between the second and fourth through cuts.

Similar to the previous embodiment, in the erect and opened carton, attached to the central closure pane are: the lift tab extending to and slightly past the edge of the carton, as well as two stop tabs adjoining the central closure panel which incorporate one complete thickness of board and a ply-separated region of about half that in thickness. Adjacent the opening formed by upward and rearward movement of the central closure pane are two stop lips formed by that ply separation in regions of the interior top panel adjacent the central closure pane. Thus, the stop lips underlie and are engageable against the stop tabs attached to the central closure providing a highly effective means of preventing the central closure pane from passing through the pour spout opening and becoming lodged inside the carton. A glue lip is formed in the minor end flap underlying the lift tab while an opening through the minor end flap underlies the opening formed in both top panels by lifting of the central closure pane.

Upon initial opening, the stop tabs are formed by the regions of the exterior top panel adjacent the central closure pane of the spout as well as by the portions of the upper plies of the interior top panel which ply-separate from those regions of the interior top panel forming the stop lips adjacent the pour spout. Similarly, a retention lip is formed by ply separation of the glue lip. Both formation of the accessory spout structure and initial opening of the pour spout itself are accomplished by lifting the protrusion away from the carton, then grasping the lift tab and pulling upwardly and rearwardly toward the center of the carton.

Reclosing is accomplished in a manner like that of the previous embodiment by inserting the lift tab into the pour spout opening then tucking it under the retention lip formed by ply-separation of the glue lip on the minor end flap underlying the two top panels. The central closure pane is retained outside of the carton by engagement of the two stop tabs against the two stop lips adjoining the pour spout opening formed through the top panels and minor end flap. Reopening may be eased by providing a portion of the central closure panel formed by the exterior top panel which extends slightly beyond the fold line of the lift tab. This portion thus contacts the lip and may be grasped by the consumer for reopening the carton.

Figure 1:
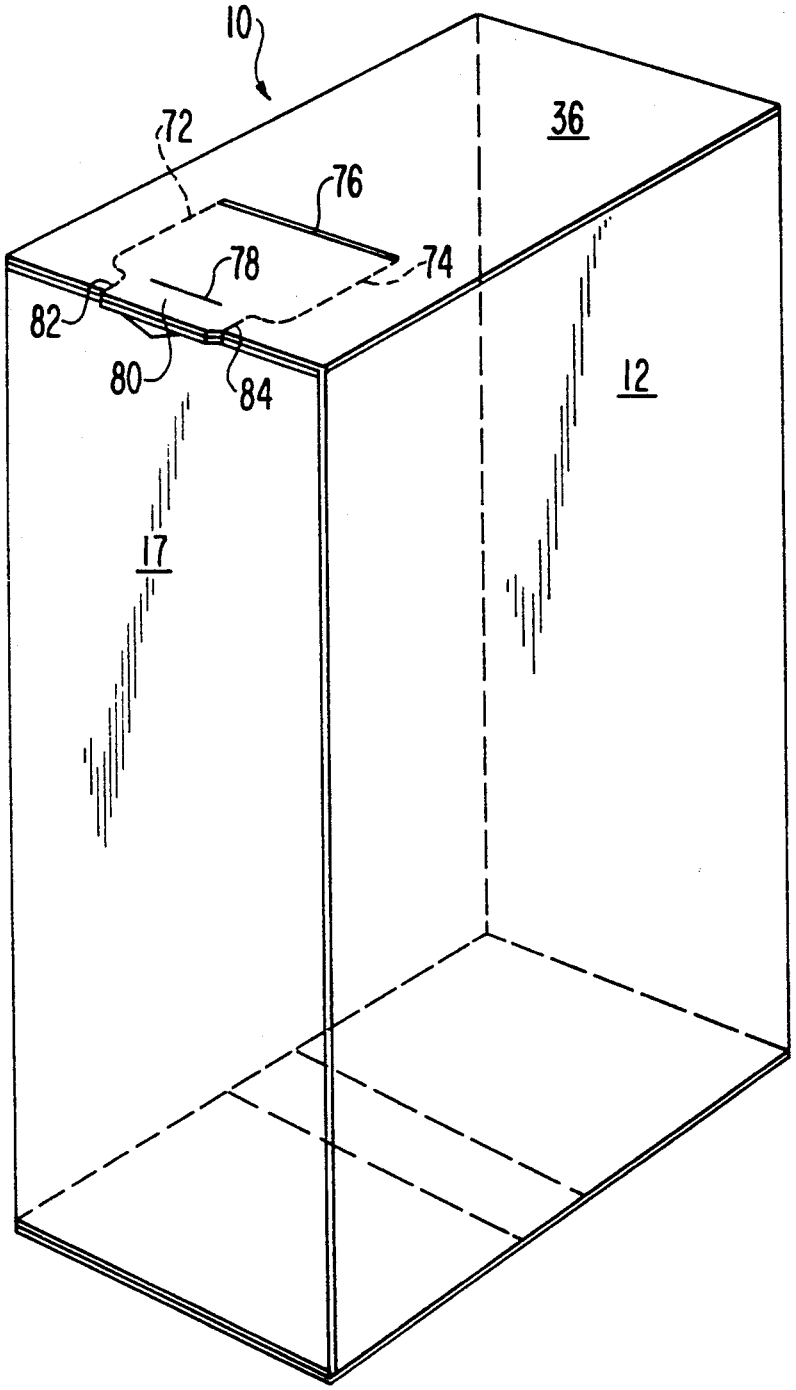
FIG. 1 is a perspective view illustrating a carton formed in accordance with an embodiment of the present invention before opening.

Throughout these Figures, the following convention is used to denote the character of the various incisions: a through cut, also sometimes referred to as a knife cut, is shown as a solid line; a crease score, as a line of long dashes of equal length; perforations, as a line of short dashes of equal length; while a cut score is indicated by a line of alternating long and short dashes.

DESCRIPTION OF THE PREFERRED EMBODIMENTS

In FIGS. 1 through 4, carton 10 comprises lateral body panels 12 and 14 hingedly joined to minor lateral panel 17. Side panel 16 hingedly adjoining main lateral panel 12 may be adhesively bonded to glue flap 18 adjoining main lateral panel 14. Shoulder 20 between main body panel 14 and glue flap 18 assists in formation of a tight corner with good sift resistance. Similarly, minor flaps 24, 26, 28 and 30 assist in providing sift resistance to the seals formed in the conventional manner by superposition of interior and exterior lower end panels 32 and 34 as well as that formed with top panels 36 and 38.

Figure 2:
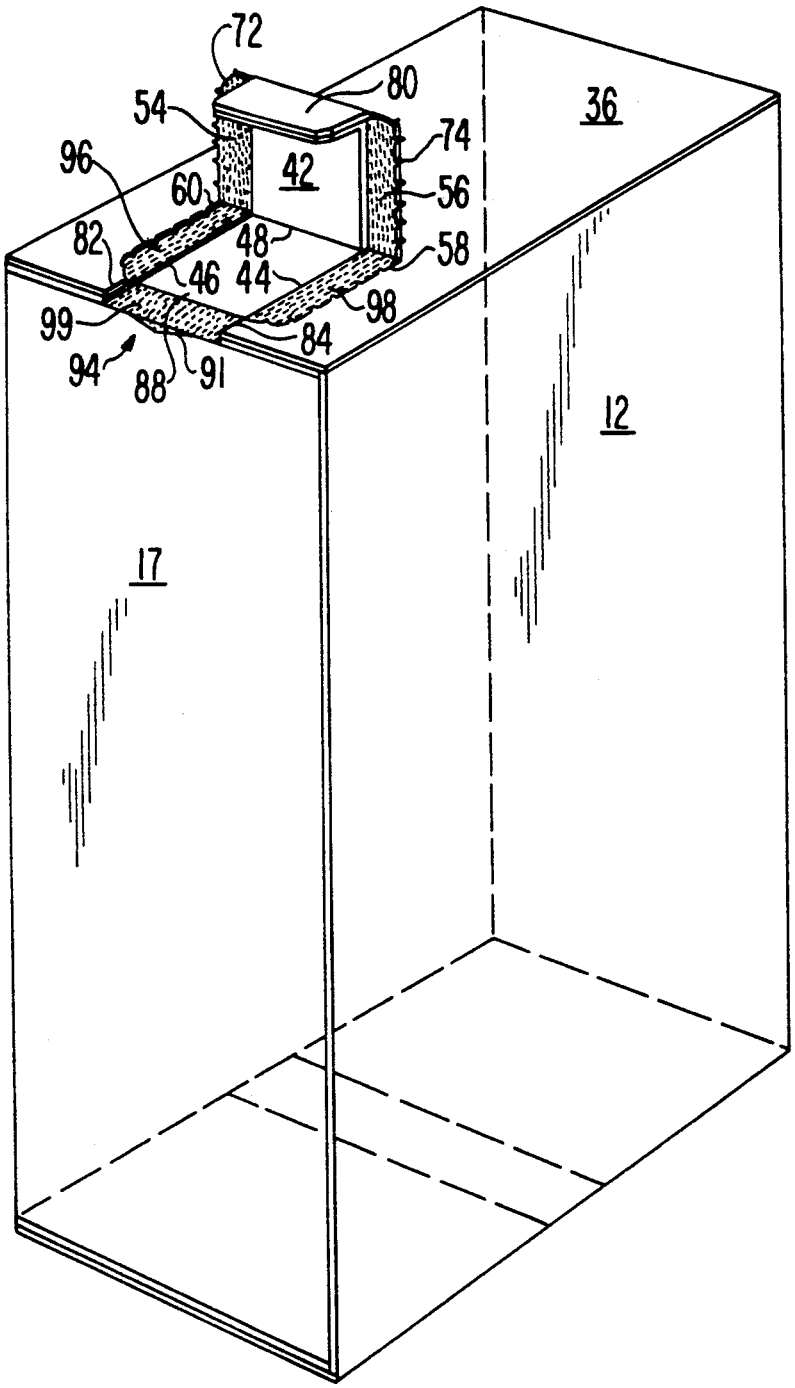
FIG. 2 is a perspective view illustrating the carton of FIG. 1 open with the lift tab folded downwardly as it would be in preparation for reclosing.
Figure 3:
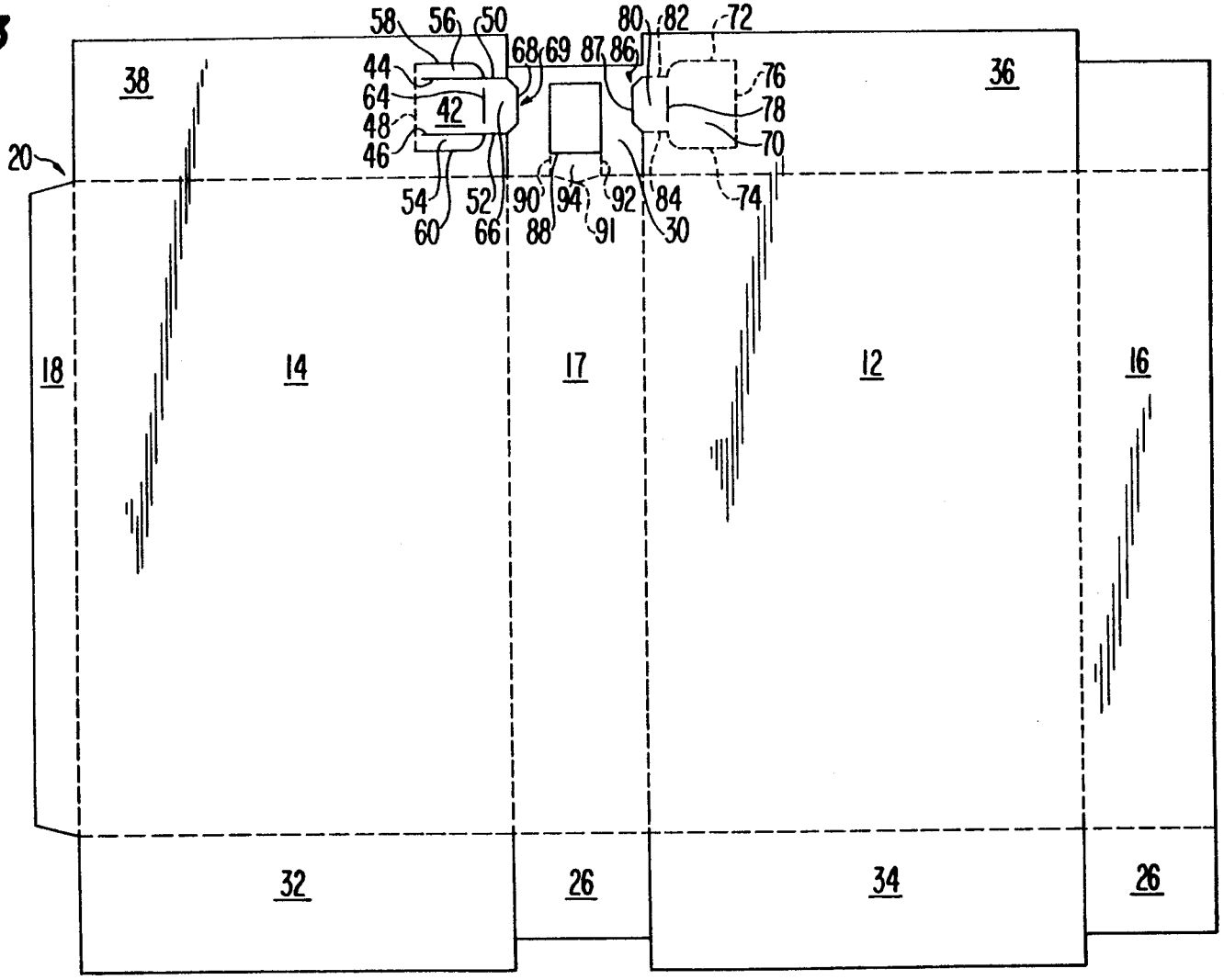
FIG. 3 is a plan view of a blank for forming the carton of FIG. 1 in accordance with an embodiment of the present invention.
Figure 4:
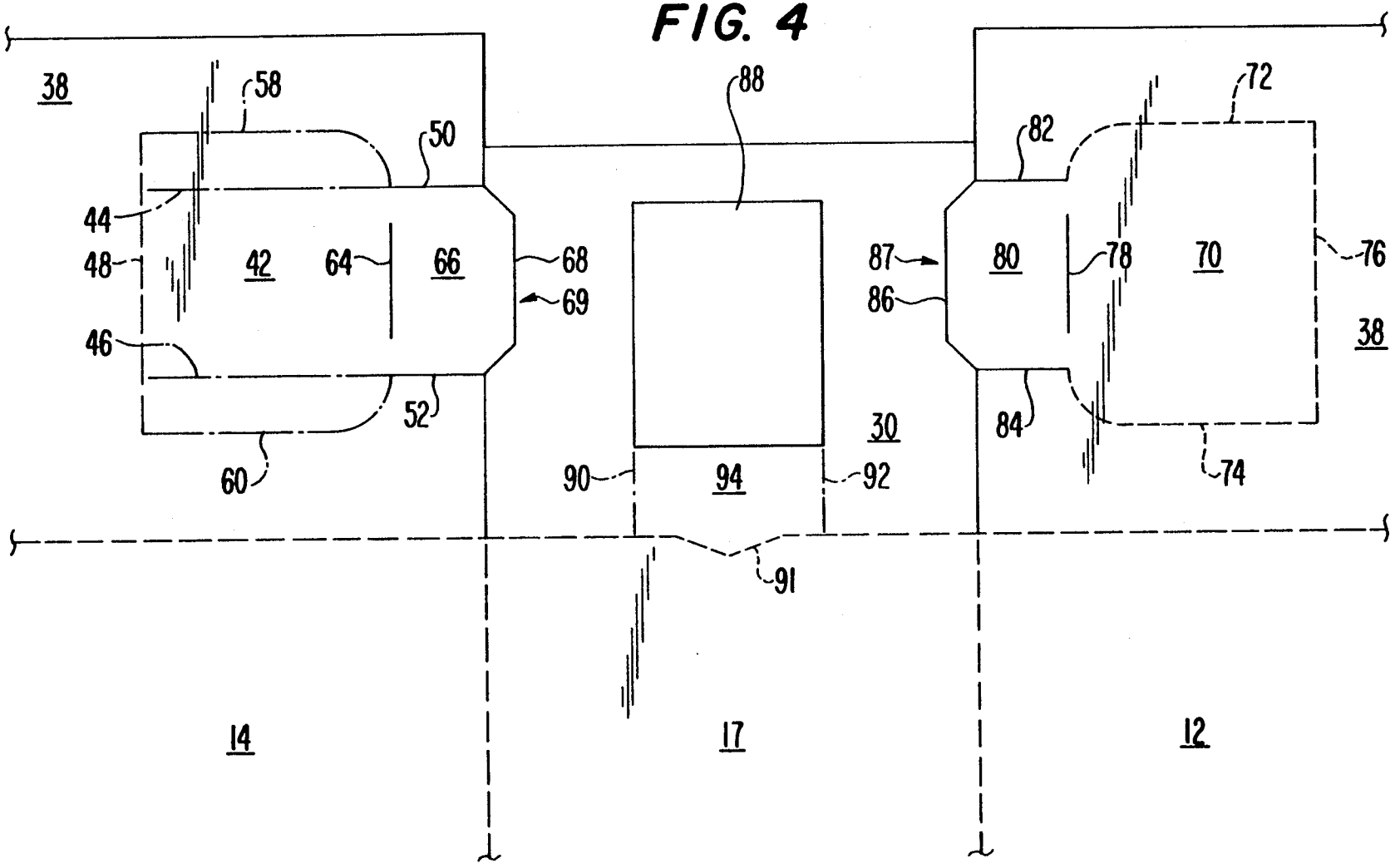
FIG. 4 is an enlargement of those portions of FIG. 3 illustrating the details of the incisions forming the spout feature of the carton of FIG. 1.
Figure 5:
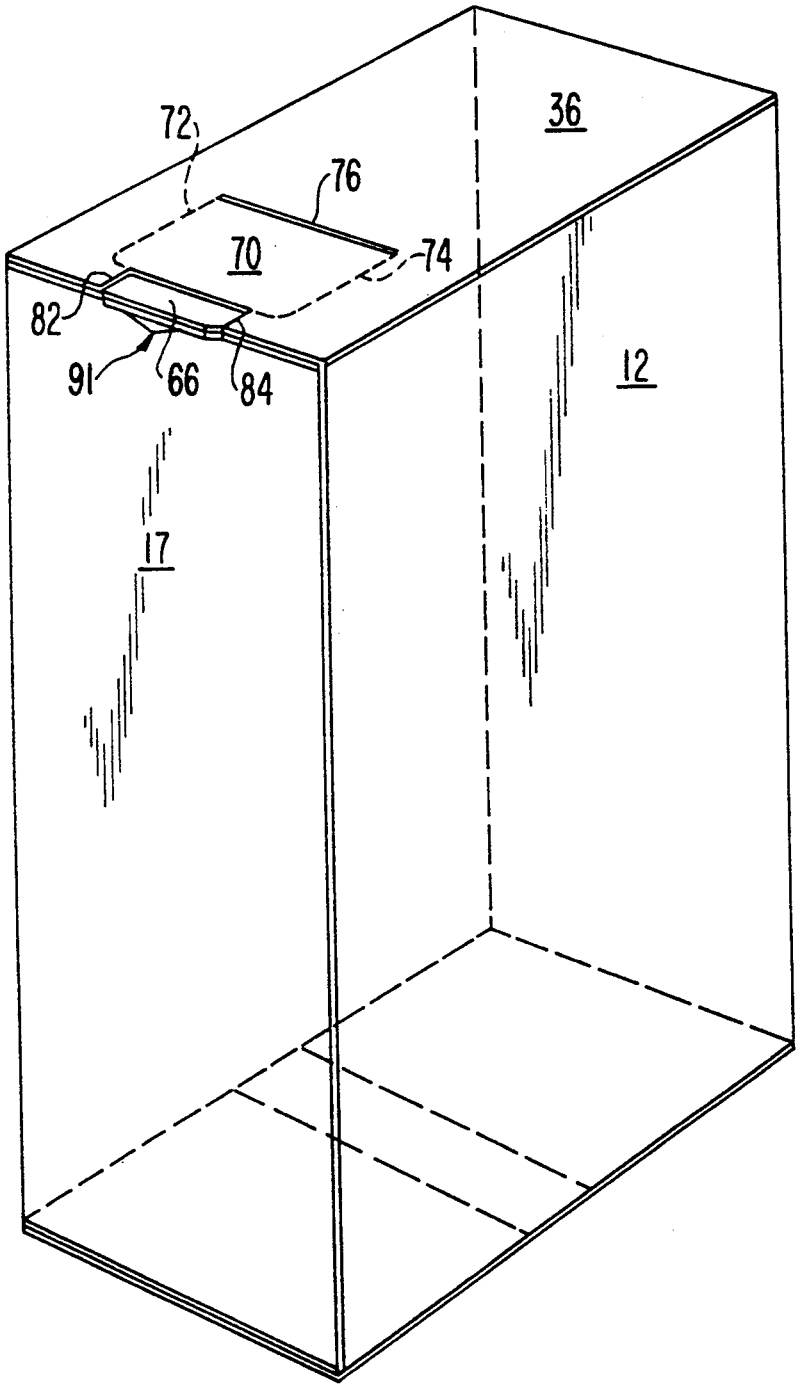
FIG. 5 is a perspective view illustrating an alternative carton of the present invention before opening.
Figure 6:
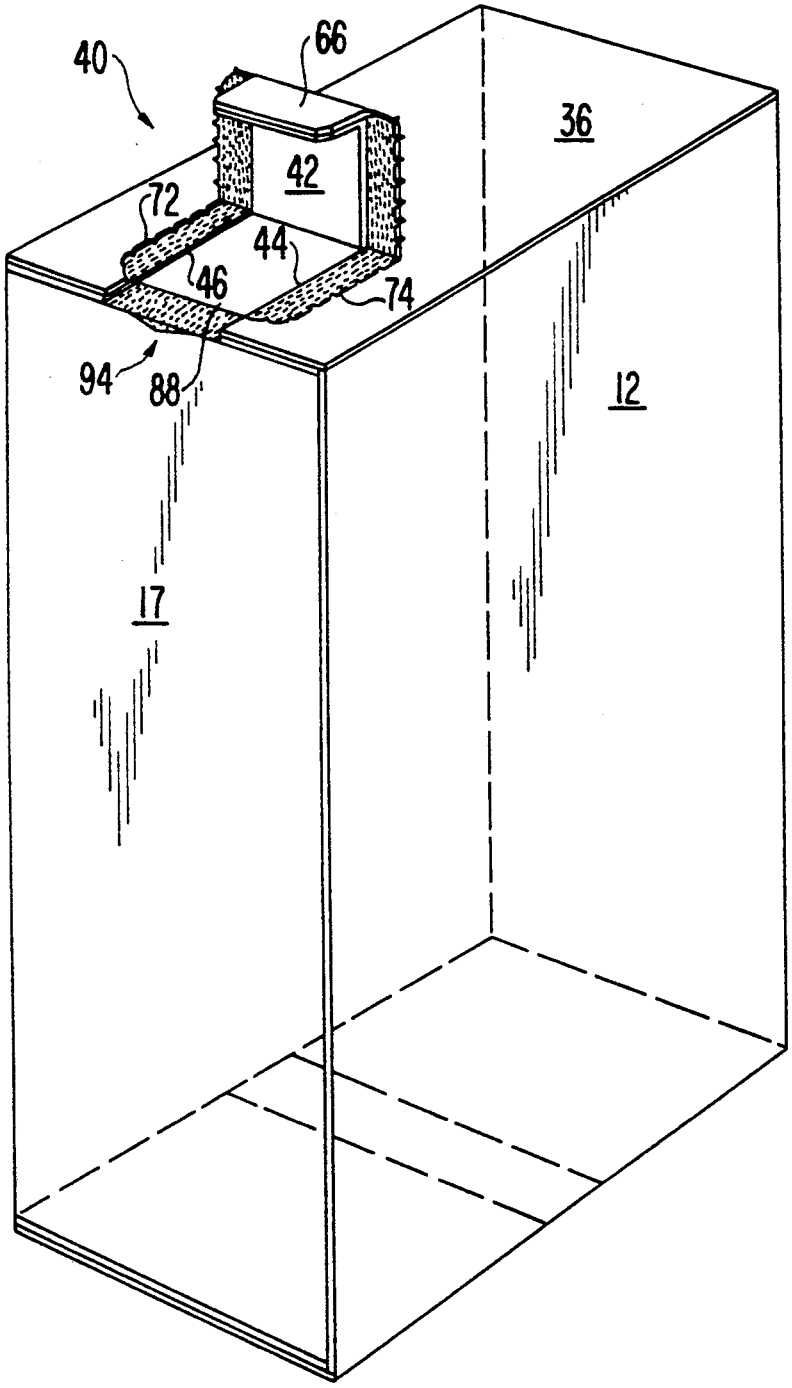
FIG. 6 is a perspective view illustrating the alternative carton of FIG. 5 open with the lift tab folded downwardly as it would be in preparation for reclosing.
Figure 7:
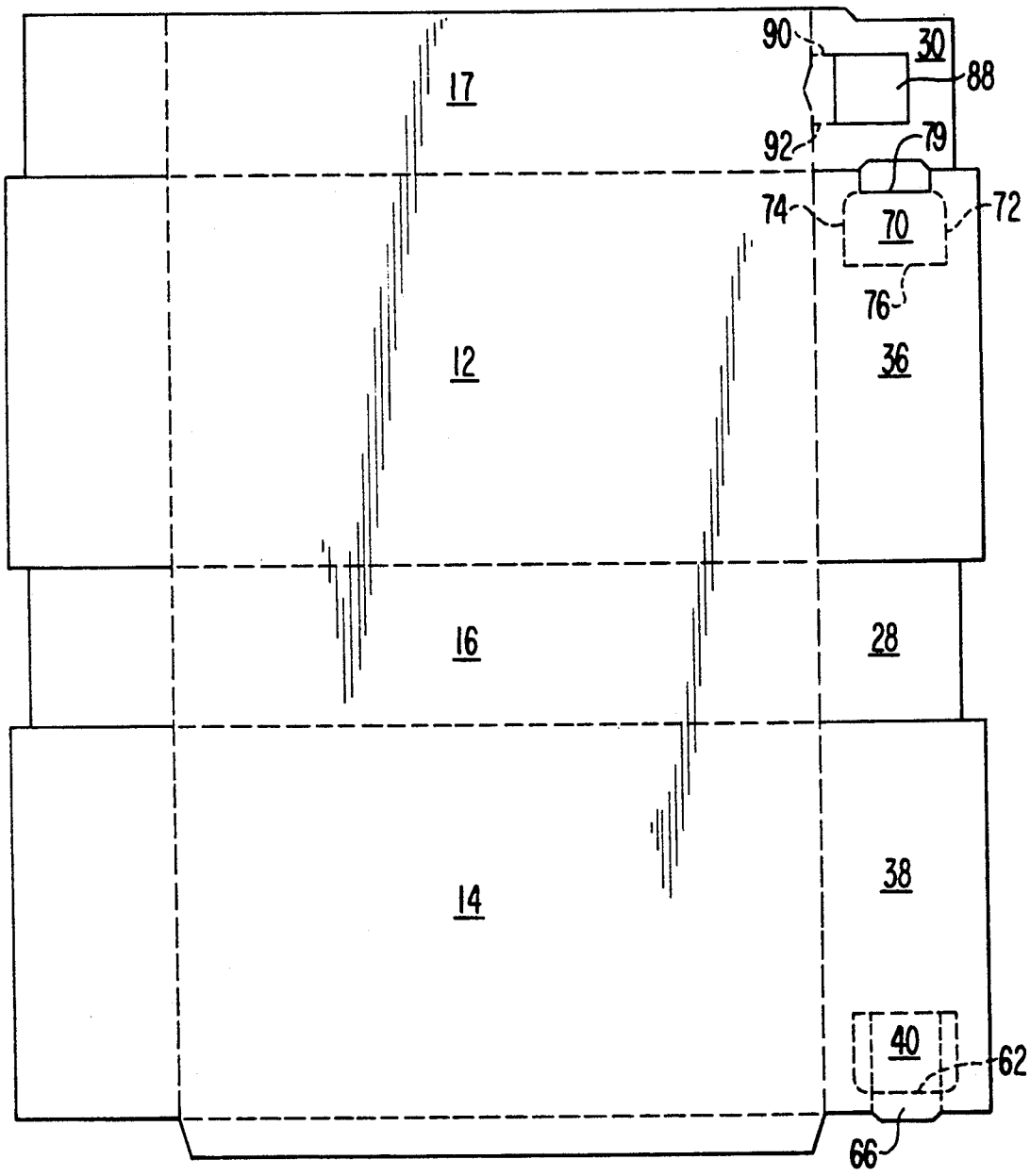
FIG. 7 is a plan view of a blank for forming the carton of FIG. 5 in accordance with the present invention.
Figure 8:
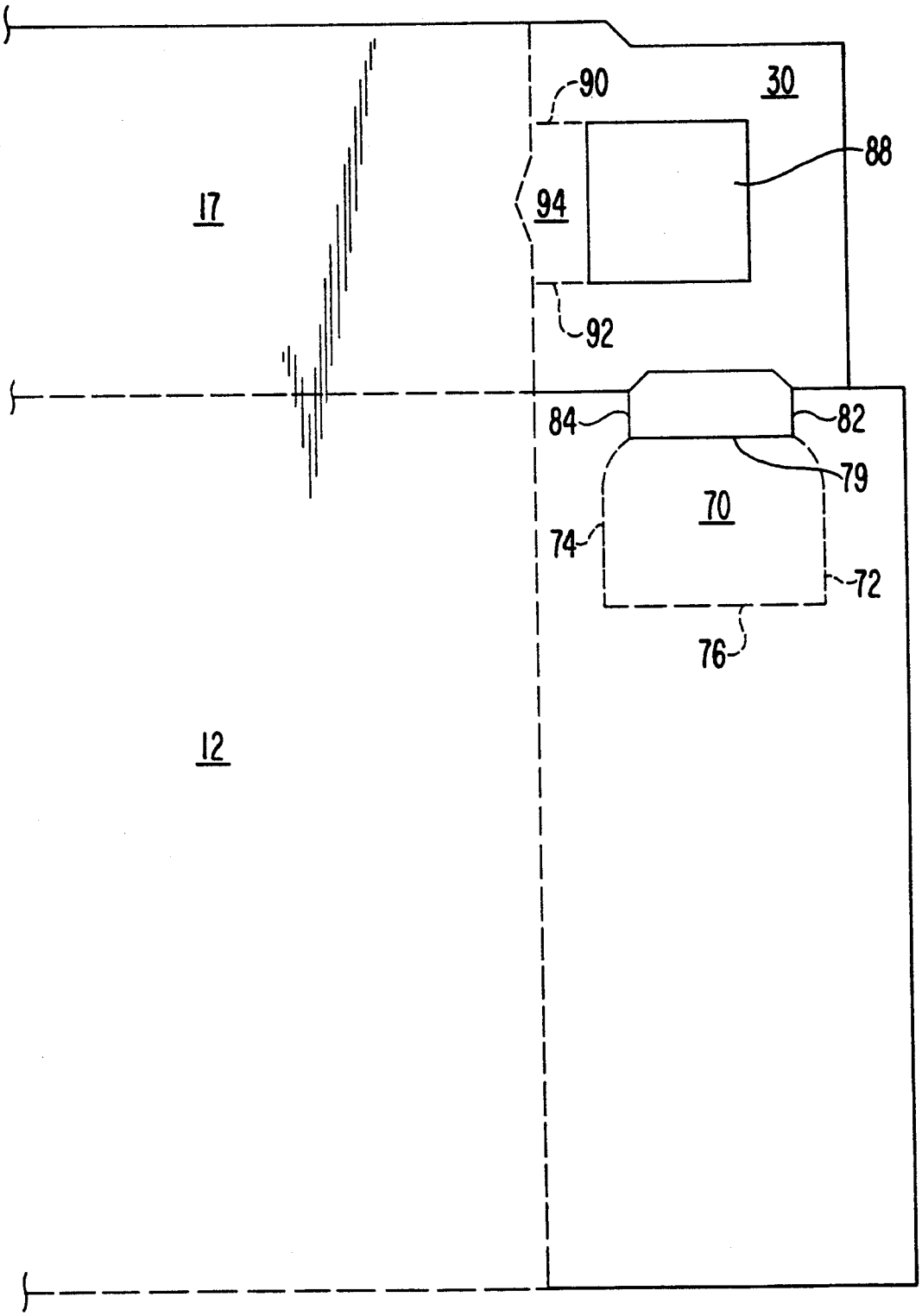
FIGS. 8 and 9 are enlargements of those portions of FIG. 7 illustrating the details of the incisions forming the spout feature of alternative cartons of the present invention.
Figure 9:
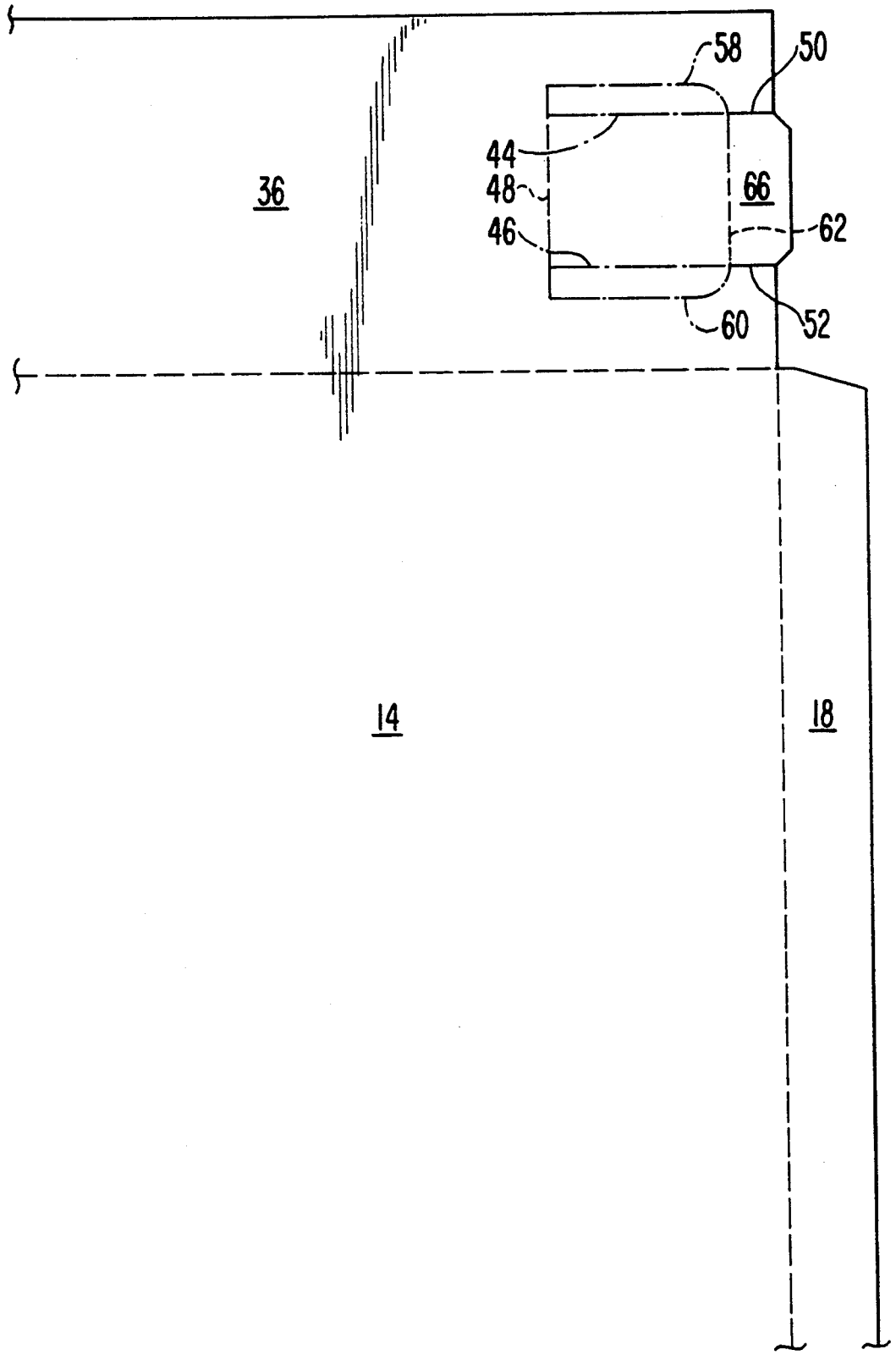

Pour spout is formed by cooperating incisions formed in: upper minor flap 30, exterior top panel 36 and interior top panel 38, the details of which are best seen in FIGS. 3 and 4. Beginning with interior top panel 38, lower central closure pane 42 is formed by inside cut scores 44 and 46 each extending from the hinge line defined by crease score 48 to through cuts 50 and 52 respectively. Stop tab 54 is formed from the upper plies of interior top panel 38 adjoining lower central closure pane 42 in the region circumscribed by inside cut score 46, crease score 48, and upper cut score 60 extending from crease score 48 to the intersection of inside cut score 46 with through cut 50 while stop tab 56 is similarly formed in the region circumscribed by crease score 48, inside cut score 44 and upper cut score 58. Preferably, inside cut scores 44 and 46 begin on the interior or lower surface of interior top panel 38 and extend upwardly through about 50% of the thickness of the board while upper cut scores 58 and 60 extend downwardly into the board for about the same distance. Lower lift tab 66 is defined by through cut 64, through cuts 50 and 52 extending from through cut 64 to through cut 68 dividing interior top panel 38 from minor flap 30 and thereby defining protrusion 69 formed at the edge of lower lift tab 66. Short through cut 64 is spaced away from each of through cuts 50 and 52 and thus is formed in the central portion of the fold line resulting when lift tab 66 is bent downward from lower central pane 42 as shown in FIG. 2 thereby easing downward folding of lower lift tab 66 for reclosing.

Exterior central closure pane 70 lies above lower central closure pane 42 while the upper portions of stop tabs 54 and 56 occupy the regions between exterior central closure pane 70 and perforated cuts 72 and 74 extending through exterior top panel 36 forward of the hinge line defined by crease score 76 and rearward of short through cut 78 in exterior top panel 36. When carton 10 is erected, perforated cuts 72 and 74 lie immediately above upper cut scores 60 and 58 respectively formed in interior top panel 38 while crease score 76 and through cut 78 are immediately above crease score 48 and through cut 64, respectively. Exterior lift tab 80 is defined by short through cut 78 as well as through cuts 82 and 84 formed in exterior top panel 36 and through cut 86 dividing exterior top panel 36 from minor flap 30 and thereby defining protuberance 87. As best seen in FIG. 4, through cuts 69 and 86 defining the boundaries between interior top panel 38, exterior top panel 36 and minor flap 30 both have convexities formed in the center thereof so that, upon erection, both protrusions 69 on lower lift tab 66 and protuberance 87 on exterior lift tab 80 extend slightly beyond the plane of minor lateral panel 17 thereby easing dislodgement and grasping of lift tabs 80 and 66. Exterior central closure pane 70 and upper lift tab 80 are adhesively bonded to lower central closure panel 42 and lower lift tab 66 so that all remain joined upon opening. Through cut 78 serves to ease downward folding of upper lift tab 80 as well as to ease retrieval of both lower lift tab 66 and exterior lift tab 80 from the pour spout opening. Aperture 88 is punched out of upper minor flap 30 and lies immediately beneath lower central closure panel 42. When upper cut scores 90, 91 and 92 are formed, glue lip 94 is embossed so that it more readily engages lower lift tab 66 so that the two are more easily joined by gluing as well as to induce incipient ply separation. This embossing may be accomplished simultaneously with formation of the blank by displacing the upper cut score knife slightly more outwardly of the counter (not shown) than normal, an offset of about twice the board caliper being suitable when used with a counter of the normal height of about the board caliper plus seven thousandths of an inch. The exaggerated offset also induces shear stress between plies of glue lip 94 contributing to ply separation in glue lip 94 between upper cut scores 90 and 92 which underlie through cuts 50 and 52 so that lift tabs 66 and 80 may be peeled back more easily. If sufficient incipient ply separation is not obtained with a counter of standard height, it may be beneficial to increase the height of the counter slightly to a height of about the board caliper plus up to fifteen thousandths of an inch usually being apt depending on the properties of the board. The slightly convex shape of upper cut score 91 also eases ply separation in plies underlying glue lip 94 as ply separation is initiated when minor flap 30 is bent inward from minor lateral panel 17.

To open the carton of the present invention illustrated in FIGS. 1–4, lift tabs 66 and 80 are lifted then gripped and pulled inwardly and rearwardly causing ply separation of glue lip 94 as well as those portions of interior top panel 38 in the two regions between inside cut scores 44 and 46 and upper cut scores 58 and 60 as well as severing exterior top panel 36 along perforations 72 and 74. Stop tabs 54 and 56 are formed by the upper plies of the regions of interior top panel 38 lying between inside cut scores 44 and 46 and upper cut scores 58 and 60 respectively as well as by that portion of exterior top panel 36 lying immediately thereabove. Stop lips 96 and 98 are formed by the underlying plies of the separated regions of interior top panel 38 while retention lip 99 is similarly formed by the underlying plies of the separated region of glue lip 94. In preferred embodiments of the present invention, to further facilitate easy opening, the machine direction of the board will be parallel to: cut scores 44 and 46; and the rearward portions of cut scores 58 and 60 as well as the rearward portions of lines of perforation 72 and 74.

The embodiment of the present invention illustrated in FIG. 5–9 differs primarily in that short through cut 78 in FIGS. 1–4 is replaced by extended through cut line 79 in FIGS. 5–9 so that exterior lift tab 80 is omitted therefrom by punching out the corresponding section of board rather than leaving it attached. While through cut 64 is replaced by crease score 62. For many carton forming machines, embodiments such as those shown in FIGS. 1–4 having the incisions surrounding a central minor flap will be preferred when the spout portion is to be formed on the trailing portion of the carton as it is fed through the carton forming machine. Whether the carton is to be fed through the machine with the spout feature leading or trailing is, of course, independent of whether a single layer or a double layer lift tab is to be used and, similarly, the minor lateral panel adjoining the minor flap bearing the glue lip may be attached to either major lateral panel as a matter of convenience. Similarly, either a single layer or double layer lift tab may be used in either configuration whether the incisions forming the opening feature are located around a central minor lateral panel or at corners of the periphery of the blank.

Figure 10:
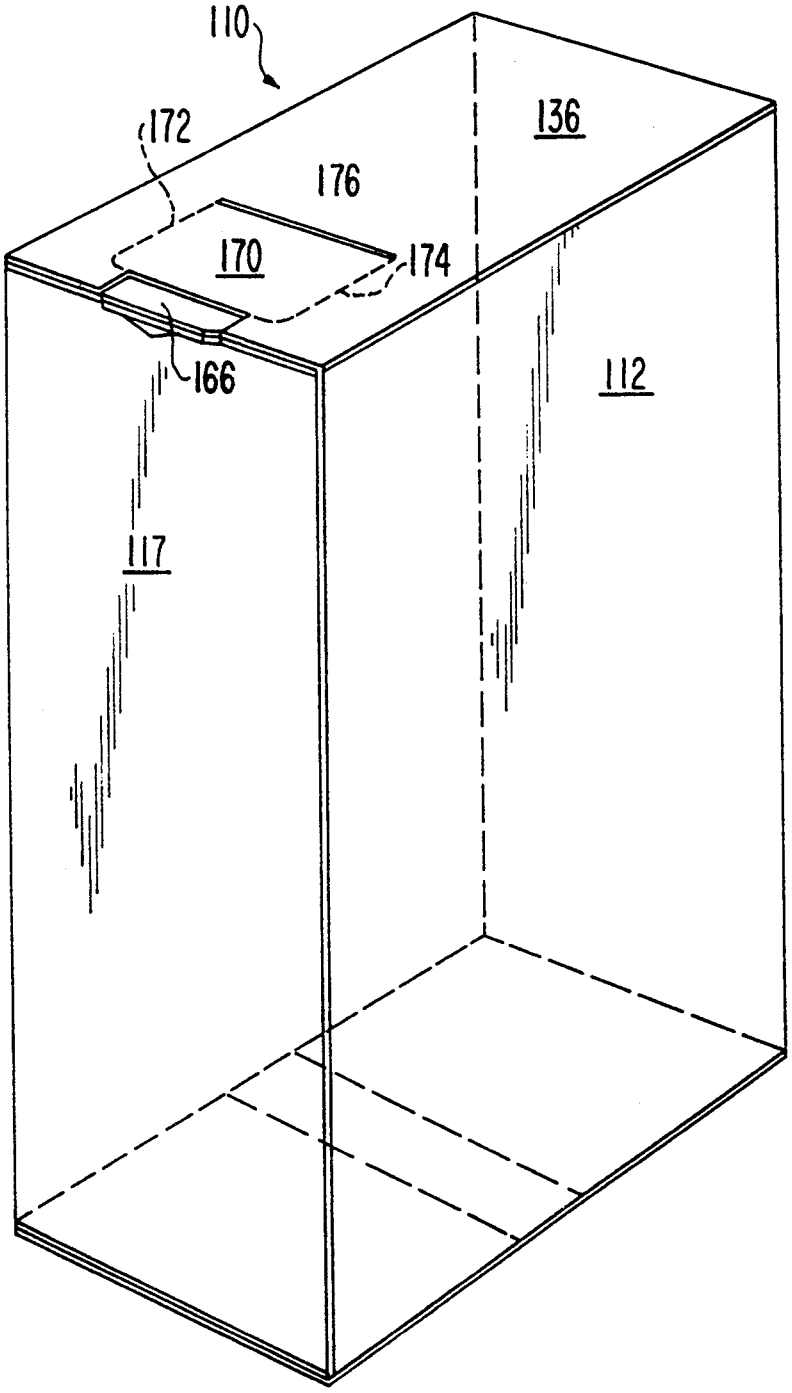
FIG. 10 is a perspective view illustrating a carton formed in accordance with an alternative embodiment of the present invention before opening.
Figure 11:
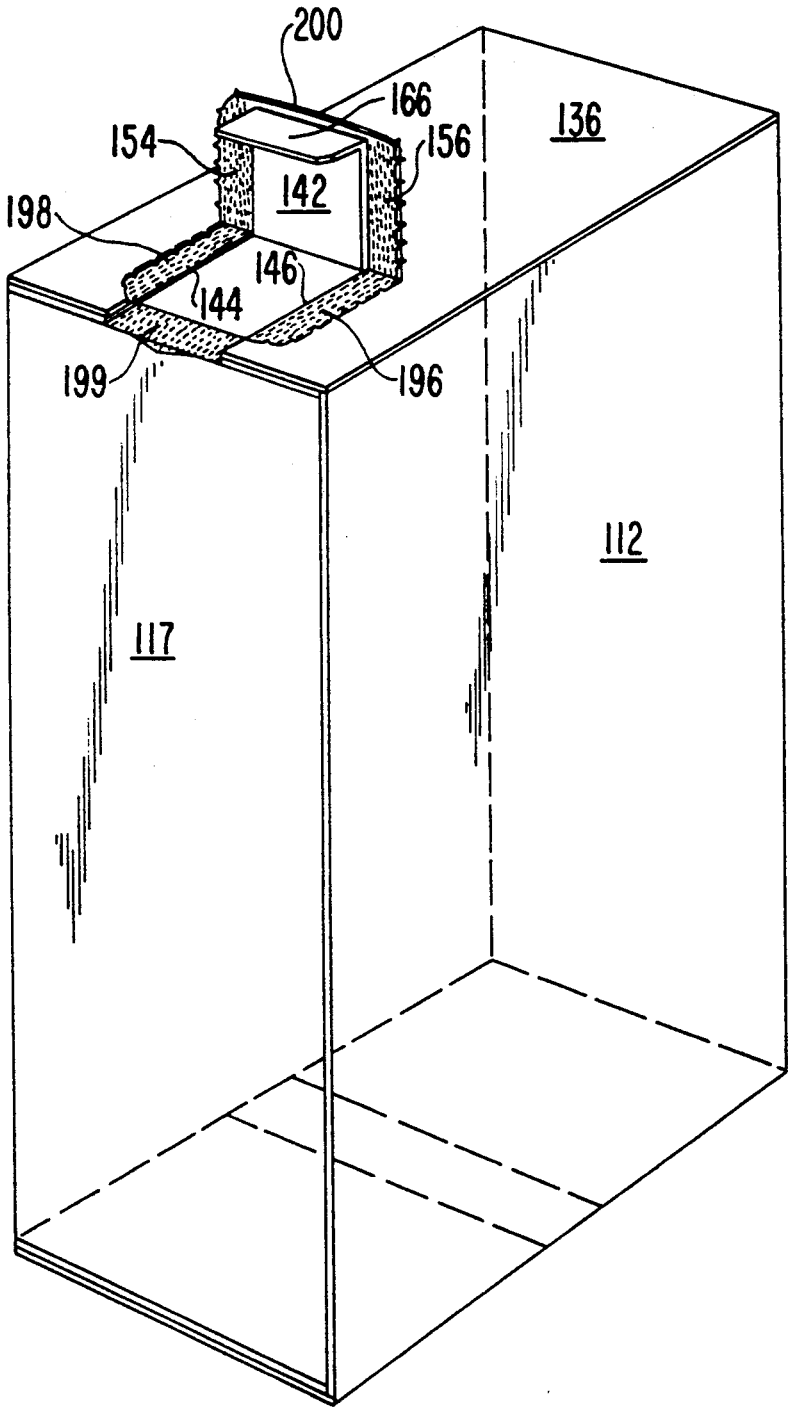
FIG. 11 is a perspective view illustrating the carton of FIG. 10 open with the lift tab folded downwardly as it would be in preparation for reclosing.
Figure 12:
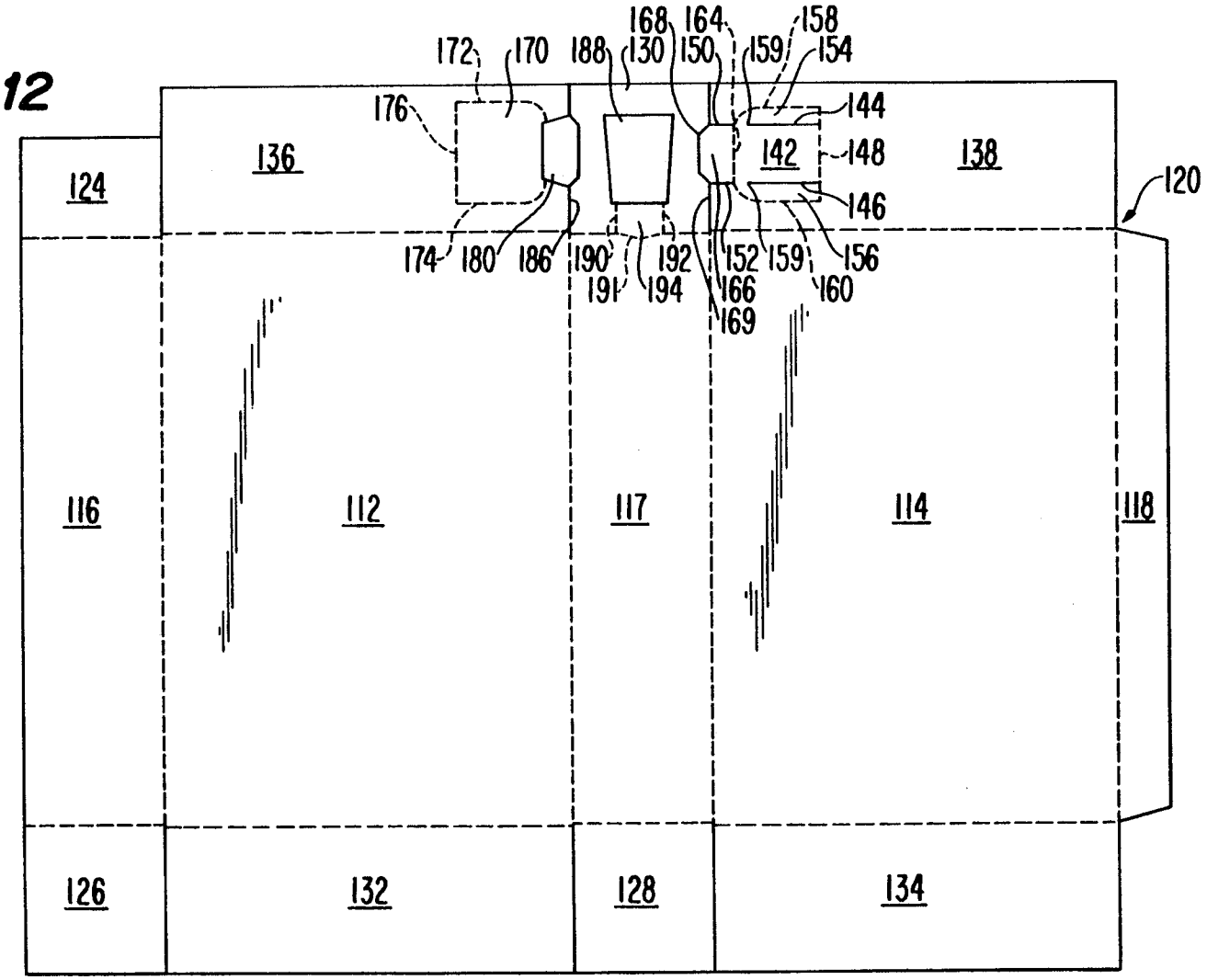
FIG. 12 is a plan view of a blank for forming the carton of FIG. 10 in accordance with an alternative embodiment of the present invention.

Referring now to FIGS. 10 through 12, carton 110 being similar to carton 10 discussed hereinabove, comprises lateral body panels 112 and 114 hingedly joined to minor lateral panel 117. Side pane 116 hingedly adjoining main lateral panel 112 may be adhesively bonded to glue flap 118 adjoining main lateral panel 114 in a manner similar to that previously discussed. Shoulder 120 between main body panel 114 and glue flap 118 assists in formation of a tight corner evidencing good sift resistance. Similarly, minor flaps 124, 126, 128 and 130 assist in providing sift resistance to the seals formed in the conventional manner by superposition of interior and exterior lower end panels 132 and 134 as well as that formed with top panels 136 and 138.

A pour spout 140 is formed by cooperating incisions formed in each of upper minor flap 130, exterior top panel 136 and interior top panel 138, the details of which are best illustrated in FIG. 12. Beginning with interior top panel 138, lower central closure pane 142 is formed by inside through cuts 144 and 146 each extending from a hinge line defined by crease score 148 to a point adjacent through cuts 150 and 152 respectively. A first stop tab 154 is formed in a manner similar to that disclosed hereinabove from the upper plies of interior top panel 138 adjoining the lower central closure pane 142 in a region circumscribed by through cut 144, crease score 148, and an upper cut score 158 extending from crease score 148 and intersecting with through cut 150 adjacent and ending 159 of through cut 144. A second stop tab 156 is similarly formed in the region circumscribed by crease score 148, Through cut 146 and upper cut score 160. Preferably, upper cut scores 158 and 160 are formed in an upper surface of interior panel 138 and extend downwardly into the board approximately 50% of the board thickness. Lift tab 166 is defined by line of weakness 164, through cuts 150 and 152 extending from line 164 to through cut 169 dividing interior top panel 138 from minor flap 130 and thereby defining protrusion 168 formed at the edge of the lift tab 166. The line of weakness 164 extends between through cuts 150 and 152 and thus forms a fold line when lift tab 166 is bent downward with respect to the lower central pane 142 as shown in FIG. 11 thereby easing downward folding of lower lift tab 166 for reclosing. The line 164 may be a cut score and intersect and form an extension of cut scores 158 and 160 or may be in the form of a crease score for aiding in the folding of lift tab 166.

An exterior central closure pane 170 lies above the lower central closure pane 142 when the blank is erected as carton 110. The upper portions of stop tabs 154 and 156 occupy the regions between exterior central closure pane 170 and perforated cuts 172 and 174 extending through exterior top panel 136 forward of the hinge line defined by crease score 176 and rearward of a cutout 180 in exterior top panel 136. When carton 110 is erected, perforated cuts 172 and 174 lie substantially above upper cut scores 160 and 158 respectively formed in interior top panel 138. In accordance with the present embodiment, the perforated cuts 172 and 174 encompass the upper cut scores 158 and 160. That is, the surface area of closure pane 170 defined by the perforated cuts 172 and 174 and crease score 176 is greater than that of pane 142. While this insures that there is sealing between the pane 170 and the surface of the interior top panel 138 outside the area designated as pane 142. The pane 170 is readily released by application or an opening force to lift tab 166. Further, any possible overlap which would inhibit opening of the pour spout is eliminated. As best seen in FIG. 12, a cut-out 180 is provided in the exterior top panel 136 which is of a greater area than that of lift tab 166. In doing so, the lift tab 166 is easily folded along line of weakness 164 where reclosure of the carton is desired, and by providing only a single thickness lift tab, the lift tab may be readily inserted into the carton and held in place. Because the cut-out 180 is of a greater surface area than the lift tab 166, the lift tab 166 can be readily raised when first opening the carton and is not obstructed by the exterior top panel 136. Additionally, through cuts 169 and 186 defining the boundaries between interior top panel 138, exterior top panel 136 and minor flap 130 both have convexities formed in the center thereof so that, upon erection, protrusion 168 on lift tab 166 extends slightly beyond the plane of minor lateral panel 117 thereby easing dislodgement and grasping of lift tab 166. The exterior central closure pane 170 is adhesively bonded to the lower central closure panel 142 so that these panes remain joined upon opening.

Aperture 188 is punched out of upper minor flap 130 and lies immediately beneath lower central closure pane 142. The punch out 188 angles outwardly at an angle of approximately 5° away from the minor lateral panel 117. This again insures that no sealing between the pane 142 and the outer periphery of the punch out 188 occurs. Further, upper cut scores 190, 191 and 192 are formed thus producing a release area or glue lip 194 which is embossed so that it more readily engages lift tab 166 so that the two are more easily joined by gluing as well as to induce incipient ply separation. As can be seen from FIG. 12, cut scores 190 and 192 are offset from the perimeter of the punch out 188, such that the cut scores 190 and 192 are not overlapped by through cuts 150 and 152 formed in the interior top panel 138. Again, this permits ply separation to occur at the glue lip 194 with the ply separation being terminated by cut scores 190 and 192 inside of through cuts 150 and 152, thereby permitting easy lifting of the lift tab 166.

As with the previous embodiment, embossing of the glue lip 194 may be accomplished simultaneously with formation of the blank by displacing the upper cut score knife slightly more outwardly of the counter (not shown) than normal, an offset of about twice the board caliper being suitable when used with a counter of the normal height of about the board caliper plus seven thousandths of an inch. The exaggerated offset also induces shear stress between plies of glue lip 194 contributing to ply separation in glue lip 194 between upper cut scores 190 and 192 which underlie through cuts 150 and 152 so that lift tab 166 may be peeled back more easily. If sufficient incipient ply separation is not obtained with a counter of standard height, it may be beneficial to increase the height of the counter slightly to a height of about the board caliper plus up to fifteen thousandths of an inch usually being apt depending on the properties of the board. The slightly convex shape of upper cut score 191 also eases ply separation in plies underlying glue lip 194 as ply separation is initiated when minor flap 130 is bent inward from minor lateral panel 117.

To open the carton of the present invention illustrated in FIGS. 10 and 11, lift tab 166 is lifted then gripped and pulled upwardly and rearwardly causing ply separation of glue lip 194 as well as those portions of interior top panel 138 in the two regions between through cuts 144 and 146 and upper cut scores 158 and 160 as well as severing exterior top panel 136 along perforations 172 and 174. As shown in FIG. 11, stop tabs 154 and 156 are formed by the upper plies of the regions of interior top panel 138 lying between through cuts 144 and 146 and upper cut scores 158 and 160 respectively as well as by that portion of exterior top panel 136 lying immediately thereabove. Stop lips 196 and 198 are formed by the underlying plies of the separated regions of interior top panel 138 while retention lip 199 is similarly formed by the underlying plies of the separated region of glue lip 194. Additionally, a stop 200 may be a portion of pane 170 which overhangs pane 142. Accordingly, when the carton is reclosed, stop 200 will contact retention lip 199 and stop tabs 154 and 156 will contact stop lips 196 and 198 respectively thereby keeping the closure from passing into the interior of the carton. Further, stop 200 may form a small tab which aids in the reopening of the closure by the consumer when desired.

As with the previously discussed embodiments of the present invention, to further facilitate easy opening, the machine direction of the board is positioned parallel to: through cuts 144 and 146; and the rearward portions of cut scores 158 and 160 as well as the rearward portions of lines of perforation 172 and 174.

While the present invention has been described with reference to preferred embodiments, it will be appreciated by those skilled in the art that the invention may be practiced otherwise and as specifically described herein without departing from the spirit and scope of the invention. It is, therefore, to be understood that the spirit and scope of the invention be limited only by the appended claims.

What is claimed is:

1. An improved paperboard carton having:

a first main later panel;

a second main lateral panel;

at least a first and second minor lateral panel disposed between said first main lateral panel and said second main lateral panel;

a bottom panel;

an exterior top panel adjoining one of said main lateral panels;

an interior top panel adjoining the other of said lateral panels and underlying said exterior top panel; and a minor flap adjoining said first minor lateral panel and underlying said interior top panel, wherein the improvement comprises:

at least one stop lip formed by ply separation of a region of said interior top panel, said region defined by an upper cut score and a closely adjacent inside cut score both being incised into said interior top panel;

a central closure pane having at least one stop tab attached thereto, said central closure pane defined by perforations formed in said exterior top panel, at least one line of said perforations overlying said upper cut score in said interior top panel, said stop tab comprising a portion of said interior top panel formable by ply separation between said upper cut score and said inside cut score and overlying said stop lip, said central closure pane being foldably connected to at least one of said top panels;

a lift tab adjoining said central closure pane; and means for separably adhering said lift tab to said minor flap.

2. The carton of claim 1 wherein said central closure pane includes a portion of said interior top panel bordered on at least two sides thereof by said inside cut scores, with said upper cut scores being spaced outwardly from each inside cut score and closely adjacent thereto and adhesively attached to a portion of said exterior top panel bordered by at least two lines of perforation, each of said lines overlying a respective one of said upper cut scores in said interior top panel.

3. The carton of claim 2 wherein said lift tab comprises a through cut extending through said exterior top panel from the edge of said exterior top panel to the line of perforation defining said central closure pane.

4. The carton of claim 3 wherein said lift tab comprises a pair of through cuts, each extending through said exterior top panel from the edge of said exterior top panel to a respective one of the lines of perforation defining said central closure pane.

5. The carton of claim 4 wherein said lift tab further comprises a second pair of through cuts, each extending through said interior top panel from the edge of said interior top panel to one of the inside cut scores underlying the lines of perforation defining said central closure pane.

6. The carton of claim 5 wherein each of said upper cut scores intersects with the closely adjacent inside cut score.

7. The carton of claim 2 wherein each of said upper cut scores intersects with the closely adjacent inside cut score and said lift tab comprises two pair of through cuts, the first extending through said exterior top panel and the second through said interior top panel each extending from the edges of the panel in which it is formed to a point at which one of the lines of perforation on said top panel defining said central closure pane overlie one of said inside cut scores.

8. An improved paperboard carton having:

a first main lateral panel;

a second main lateral panel;

a minor lateral panel disposed between said first main lateral panel and said second main lateral panel;

an exterior top panel adjoining one of said main lateral panels, said exterior top panel having three free edges, at least one first edge being substantially normal to the joint between the exterior top panel and the adjoining main lateral panel;

an interior top panel adjoining the other of said lateral panels and underlying said exterior top panel; and a minor flap adjoining said minor lateral panel and underlying said interior top panel, wherein the improvement comprises:

a first through cut formed in the exterior top panel beginning at the first free edge and being substantially normal thereto, leading rearwardly to a first line of perforation and intersecting therewith, said first line of perforation extending rearwardly to a first hinge line extending transversely across the exterior top panel of the carton substantially normal to the first line of perforation, a second line of perforations intersecting said first hinge line and leading forwardly, a second through cut intersecting said second line of perforations and extending forwardly to the edge of the carton, a third through cut formed in the interior top panel immediately underlying the first through cut, extending rearwardly therebeneath, a first upper cut score formed in the interior top panel intersecting with the third through cut at a point underlying the intersection of the first through cut and the first line of perforations, said first upper cut score underlying the first line of perforations and extending rearwardly to a second hinge line formed in the interior top panel underlying said first hinge line, a first interior cut score formed in the interior top panel beginning at the intersection of the third through cut with the first upper cut score and extending rearwardly to the second hinge line along a line displaced inwardly from the first upper cut score and between the first and second lines of perforations, a second upper cut score formed in the interior top panel underlying the second line of perforations and extending forwardly from said second hinge line to a point underlying the intersection of the second through cut with the second line of perforations, a fourth through cut formed in the interior top panel underlying the second through cut extending forwardly to edge of the carton and intersecting with said second upper cut score, a second interior cut score beginning at a point intersecting the second hinge line between the first interior cut score and the second line of perforations, extending forwardly to a point underlying the intersection of the second upper cut score and the fourth through cut, and a portion of the interior top panel protruding beyond the edge of the carton between the third and fourth through cuts.

9. The carton of claim 8 wherein an aperture is formed in the minor flap underlying the region defined by the first and second interior cut scores, the first hinge line and an imaginary line extending between the intersections of each of the first and second through cuts with its adjoining line of perforations.

10. The carton of claim 8 further comprising a portion of the exterior top panel protruding beyond the edge of the carton between the first and second through cuts.

11. The carton of claim 8 further comprising third and fourth upper cut scores formed in the minor flap underlying the third and fourth through cuts and each extending rearwardly beneath one of said third and fourth through cuts to a point lying beneath the intersection of said respective through cut with the adjoining upper cut score formed in the interior top panel.

12. The carton of claim 11 further comprising a protuberance formed from one of said top panels extending beyond the plane defined by said minor lateral panel.

13. The carton of claim 8 further comprising a protuberance formed from one of said top panels extending beyond the plane defined by said minor lateral panel.

14. An improved paperboard carton having:

a first main lateral panel;

a second main lateral panel;

a minor lateral panel disposed between said first main lateral panel and said second main lateral panel;

an exterior top panel adjoining one of said main lateral panels;

an interior top panel adjoining the other of said lateral panels and underlying said exterior top panel; and a minor flap adjoining said minor lateral panel and underlying said interior top panel, wherein the improvement comprises:

at least one stop lip and at least one mating stop tab formed by ply separation of a region of said interior top panel, comprising an upper cut score and a closely adjacent inside cut score incised into said interior top panel circumscribing said region, a portion of said interior top panel forming said stop tab being plies in said region adjacent to plies forming said stop lip;

a central closure pane having said stop tab attached thereto, said means comprising perforations formed in said exterior top panel, at least one line of said perforations in said exterior top panel being juxtaposed to a respective one of said cut scores in said interior top panel, said central closure pane being foldably connected to said exterior top panel;

a lift tab adjoining said central closure pane; and means for separably adhering said lift tab to said minor flap.

15. The carton of claim 14 wherein said central closure pane includes a portion of said interior top panel bordered on at least two sides thereof by cut scores formed into one surface of said interior top panel, with an opposing cut score being spaced outwardly from but closely adjacent to each cut score formed in said one surface, said central closure pane being adhesively attached to a portion of said exterior top panel with said central closure pane further comprising at least two lines of perforation bordering said pane, each of said lines being juxtaposed to one of said cut scores in said interior top panel.

16. The carton of claim 15 wherein said lift tab is defined by a through cut extending through said exterior top panel from the edge of said exterior top panel to the line of perforation defining said central closure pane.

17. The carton of claim 15 wherein said lift tab is defined by a pair of through cuts, each extending through said exterior top panel from the edge of said exterior top panel to one of the lines of perforation defining said central closure pane.

18. The carton of claim 17 wherein said lift tab is further defined by a second pair of through cuts, each extending through said interior top panel from the edge of said interior top panel to one of the cut scores juxtaposed to the lines of perforation defining said central closure pane.

19. The carton of claim 18 wherein each of said cut scores formed in said one surface of said interior top panel intersects with the opposing cut score located closely adjacent thereto.

20. The carton of claim 15 wherein each of said cut scores formed in said one surface of said interior top panel intersects with the opposing cut score located closely adjacent thereto and wherein said lift tab comprises two pair of through cuts, each of one pair extending through said interior top panel from the edge thereof to a point at which one of the lines of perforation on said exterior panel defining said central pane are juxtaposed to one of said cut scores, and each of the other pair extending through said exterior top panel from the edges thereof to a point at which one of the lines of perforation on said exterior top panel defining said central pane are juxtaposed to one of said cut scores.

21. The carton of claim 14 wherein said lift tab comprises a through cut extending through said exterior top panel from the edge of said exterior top panel to the perforations defining said central closure pane.

22. A paperboard carton having:

a first main lateral panel;

a second main lateral panel;

at least one minor lateral panel disposed between said first main lateral panel and said second main lateral panel;

an exterior top panel adjoining one of said main lateral panels;

an interior top panel adjoining the other of said lateral panels and underlying said exterior top panel; and a minor flap adjoining said minor lateral panel and underlying said interior top panel, with said exterior top panel, said interior top panel and said minor flap forming an opening and reclosure means for opening and reclosing the carton, said opening and reclosure means comprising;

at least one stop lip incised into said interior top panel, said means comprising and including at least one ply separation region;

a central closure pane having at least one stop tab attached thereto, said central closure pane comprising perforations formed in said exterior top panel in a surrounding relationship about said stop lip; said stop tab also comprising a portion of said interior top panel formable by ply separation thereof overlying said stop lip, said central closure pane being foldably connected to at least one of said top panels;

a lift tab adjoining said central closure pane; and means for separably adhering said lift tab to said minor flap.

23. The carton of claim 22, wherein said stop lip includes at least one upper cut score formed in said interior top panel and at least one through cut positioned substantially parallel to and spaced apart from said upper cut score in a manner such that said upper cut score and said through cut do not intersect.

24. The carton of claim 23 wherein said central closure pane includes a portion of said interior top panel bordered on at least two sides thereof by through cuts with the upper cut score extending substantially parallel to and spaced outwardly from each through cut score, said central closure pane being adhesively attached to a portion of said exterior top panel bordered by at least two lines of perforation, each of said lines of perforation being spaced outwardly of said upper cut scores forced in said interior top panel.

25. The carton of claim 24 wherein said lift tab further comprises a through cut extending through said interior top panel from an edge of said top panel to the outside cut scores.

26. The carton of claim 24 wherein said lift tab further comprises a pair of through cuts, each extending through said interior top panel from an edge of said top panel to a respective one of the outside cut scores.

27. The carton of claim 26, wherein at least the portion of said exterior top panel overlying said lift tab is cutout of said exterior top panel.

28. The carton of claim 26 wherein the cutout portion of said exterior top panel is greater in area than said lift tab.

29. The carton of claim 26, further comprising a release area formed in said minor flap and underlying said lift tab, said lift tab being adhered to said release area, wherein ply separation occurs at said release area when a opening force is applied to said lift tab.

30. A paperboard carton comprising:

a first main lateral panel;

a second main lateral panel;

a minor lateral panel disposed between said first main lateral panel and said second main lateral panel;

an exterior top panel adjoining one of said main lateral panels, said exterior top panel having three free edges, at least one first edge being substantially normal to the joint between the exterior top panel and the adjoining main lateral panel;

an interior top panel adjoining the other of said lateral panels and underlying said exterior top panel;

a minor flap adjoining said minor lateral panel and underlying said interior top panel, and an opening and reclosure means for opening and reclosing said carton comprising;

a cutout formed in the exterior top panel beginning adjacent the first free edge leading rearwardly to a first line of perforations intersecting therewith and extending rearwardly to a first hinge line extending transversely across the exterior top panel of the carton substantially normal to the line of perforations, a second line of perforations intersecting said first hinge line and leading forwardly and intersecting said cutout, a first through cut formed in the interior top panel adjacent a periphery of said cut out and extending rearwardly therebeneath, a first upper cut score formed in the interior top panel intersecting with the first through cut at a point underlying the intersection of the cutout and the first line of perforations, said first upper cut score substantially underlying the first line of perforations and extending rearwardly to a second hinge line formed in the interior top panel substantially underlying said first hinge line, a second through cut formed in the interior top panel beginning adjacent to the intersection of the first through cut with the first upper cut score and extending substantially parallel to the first upper cut score to the second hinge line along a line displaced inwardly from the first upper cut score, a second upper cut score formed in the interior top panel substantially underlying the second line of perforations and extending forwardly to a point underlying the intersection of the cutout with the second line of perforations, a third through cut formed in the interior top panel adjacent a periphery of said cutout and extending forwardly to the first free edge of the carton and intersecting with said second upper cut score, a fourth through cut formed in the interior top panel beginning at a point intersecting the second hinge line between the second through cut and the second line of perforations and extending forwardly to a point adjacent to the intersection of the second upper cut score and the third through cut.

31. The carton of claim 30 wherein an aperture is formed in the minor flap underlying the region defined by at least the second and fourth through cuts, the first hinge line and an imaginary line extending between the intersections of each of the first and third through cuts with their adjoining upper cut scores.

32. The carton of claim 30 further comprising third and fourth upper cut scores formed in the minor flap underlying the first and fourth through cuts and each extending rearwardly beneath a respective one of said first and fourth through cuts to a point lying beneath the intersection of said respective through cut with the adjoining upper cut score formed in the interior top panel.

33. The carton of claim 30, wherein each of said first and second upper cut scores are spaced inwardly of the respective line of perforations.

34. The carton of claim 31, wherein said aperture formed in said minor flap is of a greater area than that area defined by the second and third through cuts, the first hinge line and the imaginary line.

35. The carton of claim 30, further comprising a lift tab defined by said first and third through cuts, said imaginary line and said first free edge.

36. The carton of claim 35 wherein the cutout portion of said exterior top panel is greater in area than said lift tab.

37. The carton of claim 36, wherein a portion of said lift tab extends beyond a plane formed by said minor lateral panel.

38. The carton of claim 35, further comprising a release area formed in said minor flap and underlying said lift tab, said lift tab being adhered to said release area, wherein ply separation occurs at said release area when an opening force is applied to said lift tab.

39. A paperboard blank for forming a carton having a top pour spout for dispensing a product contained therein comprising:

a first main lateral panel;

a second main lateral panel;

a first minor lateral panel disposed between said first and second main lateral panels;

a second minor lateral panel adjacent one of said first and second main panels;

an exterior top panel adjoining one of said main lateral panels;

an interior top panel adjoining the other of said main lateral panels;

first and second minor flaps adjoining said respective first and second minor lateral panels; and an opening forming means for permitting access to the product;

said opening forming means comprising;

an aperture formed in a central portion of one of said first and second minor flaps, an opening force receiving means formed in said interior top panel for overlying said aperture comprising;

a lift tab defined by a free edge of said interior top panel and a first and second substantially parallel through cuts extending from said free edge;

third and fourth through cuts substantially collinear with respective first and second through cuts and spaced apart therefrom and extending to a first hinge line in said interior top panel, said first hinge line extending substantially parallel to said free edge; and first and second upper cut scores extending from said hinge line substantially parallel to said third and fourth through cuts and intersecting said first and second through cuts; and a closure means for closing the carton, said closure means defined by first and second lines of perforation formed in said exterior top panel extending substantially parallel to one another from a free edge of said exterior top panel to a second hinge line formed in said exterior top panel, said second hinge line positioned so as to substantially overlay said first hinge line in a formed carton.

40. The blank of claim 39, wherein an area defined by said aperture is greater than an area defined by said first hinge line, said third and fourth through cuts and imaginary line extending between the intersection of said first through cut and said first upper cut score and said second through cut and said second upper cut score.

41. The blank of claim 39, wherein said first and second lines of perforation are spaced apart a greater distance than said first and second upper cut scores.

42. The blank of claim 39, further comprising a cutout formed adjacent said free edge of said exterior panel, wherein said first and second lines of perforation extend from said cutout.

* * * * *